US009440482B2

(12) United States Patent
Cunningham

(10) Patent No.: US 9,440,482 B2
(45) Date of Patent: Sep. 13, 2016

(54) ADJUSTABLE GRID DRAWING FRAME

(71) Applicant: David Cunningham, Christiansburg, VA (US)

(72) Inventor: David Cunningham, Christiansburg, VA (US)

( * ) Notice: Subject to any disclaimer, the term of this patent is extended or adjusted under 35 U.S.C. 154(b) by 0 days.

(21) Appl. No.: 14/329,370

(22) Filed: Jul. 11, 2014

(65) Prior Publication Data

US 2015/0013176 A1 Jan. 15, 2015

Related U.S. Application Data

(60) Provisional application No. 61/845,208, filed on Jul. 11, 2013.

(51) Int. Cl.
*B43L 13/00* (2006.01)
*B43L 13/14* (2006.01)

(52) U.S. Cl.
CPC ..... *B43L 13/149* (2013.01); *B43L 13/148* (2013.01)

(58) Field of Classification Search
CPC ..... B43L 13/02; B43L 13/14; B43L 13/16
USPC ..... 33/454, 18.1, 32.7, 563
See application file for complete search history.

(56) References Cited

U.S. PATENT DOCUMENTS 1,622,229 A * 3/1927 Ormiston ..... B43L 13/16 33/1 K
1,821,252 A * 9/1931 Woods ..... B43L 13/18 33/277
1,987,635 A * 1/1935 Poeppelmeier ..... G03F 1/90 33/615
3,660,903 A 5/1972 Caperton, Jr.
3,786,568 A * 1/1974 Schulte ..... G09B 23/04 33/1 K
3,939,564 A * 2/1976 Slawinski ..... B44D 3/185 33/1 K
4,001,941 A * 1/1977 Cruz ..... B43L 13/16 33/1 K
5,636,461 A * 6/1997 Shewmaker ..... D04G 3/02 33/1 K
5,673,490 A 10/1997 Hill
6,539,643 B1 * 4/2003 Gleeson ..... E04C 2/043 33/1 B
6,579,099 B1 6/2003 Pipes, Jr.
6,691,422 B1 * 2/2004 Aroch ..... G03B 27/582 33/427
7,389,589 B2 6/2008 Debold
7,926,188 B2 4/2011 Thorkelson
2015/0013176 A1 * 1/2015 Cunningham ..... B43L 13/149 33/454

* cited by examiner

*Primary Examiner* — Yaritza Guadalupe-McCall
(74) *Attorney, Agent, or Firm* — Global Intellectual Property Agency, LLC; Daniel Boudwin

(57) ABSTRACT

A drawing tool is provided for assisting artists in transcribing images onto a blank medium. The device is a drawing frame of geometrical shape and has a plurality of notches disposed along the outer perimeter length. These notches are channels cut out of the edge, forming protruding segments between any two notches. Protruding segments are used as anchor sites for a series of elastic threads. A portion of the threads is wound around protruding segments disposed on opposing dies of the frame body, thereby stretching the elastic thread across the front surface of the frame body. A first grouping of the threads is secured in parallel lateral alignment, while a second group is secured in a parallel longitudinal alignment. This configuration presents a grid pattern that can be laid over an image or blank piece of paper to serve as a guide for transcription.

3 Claims, 2 Drawing Sheets

ADJUSTABLE GRID DRAWING FRAME

CROSS REFERENCE TO RELATED APPLICATION

This application claims the benefit of U.S. Provisional Application No. 61/845,208 filed on Jul. 11, 2013, entitled "Proportional Drawing Frame." The above-identified patent application is herein incorporated by reference in its entirety to provide continuity of disclosure.

BACKGROUND OF THE INVENTION

Field of the Invention

The present invention relates to a drawing tool. More specifically, it relates to a portable frame that enables use of an adjustable grid pattern to draw correctly on an underlying sheet of paper. Users can modify grid line placement to suit desired proportions. Sketch artists, and persons who use grid lines to produce artwork will appreciate the invention.

Artists and architects often have difficulty transcribing images and scenes onto paper without distorting perspective and proportionality. As new artists, people sometimes do not understand rules of proportionality. Others find it difficult to accurately gauge the resulting size of an object being transcribed. Even experienced architects and artists may find it difficult to sketch a subject or object freehand without the aid of reference markers.

Reference markers such as length measurement indicators or grid patterns can help artists the size of scene elements to relation to one another. For example, if markings on an image indicate that certain sections are 1" high, then the artist knows that these elements should be approximately the same size. Over time, individuals who practice with such markings will be able to visually assess the size of scene elements without referring to the markings.

Placing grid lines on both a sheet of drawing paper and a subject image, can greatly increase accuracy of proportionality in the end product. Artists can quickly view the parts of the image associated with a grid sector and transcribe it to a corresponding sector on their drawing paper. This technique works especially well for large or complicated images. The problem with this technique is that grid patterns are usually pre-printed and are therefore not modifiable in size or alignment configuration.

A drawing grid is needed that enables users to modify the size and alignment of grid sectors. The present invention solves this problem by provided notched edges and elastic threading that can be wound around the notched segments. In use the elastic threads form the line of a grid pattern that can be modified by adjusting the position and placement of the threads with respect to the underlying board.

DESCRIPTION OF THE PRIOR ART

Devices have been disclosed in the prior art that relate to drawing frames. These include devices that have been patented and published in patent application publications. These devices generally relate to enabling proper proportionality during artwork production. The following is a list of devices deemed most relevant to the present disclosure, which are herein described for the purposes of highlighting and differentiating the unique aspects of the present invention, and further highlighting the drawbacks existing in the prior art.

Debold, U.S. Pat. No. 7,389,589 teaches a drawing frame made from a transparent substance and having a plurality of gridlines disposed thereon. A piece of artwork is placed on the transparent frame such that it is visible through the transparent material. Light may be shown from behind the image in order to create a projection of the image and corresponding gridlines on a wall, or piece of paper. Projected images are then traced in pencil onto the wall or paper. In this way, the invention facilitates transfer of images to larger surfaces, without loss of proportionality. Unlike the present invention, the gridlines of the Debold invention are not adjustable, and the frame itself does not include notches edges or elastic threading.

A similar device is disclosed by Thorkelson in U.S. Pat. No. 7,926,188. The device is a transparent card with distance indicators in the form of gridlines and measurements. Some of the grid lines may be bolded to assist users with visual determination of element spacing. An image placed behind the transparent card can be clearly seen through the card. Users can transcribe he visible image onto another medium by drawing one grid sector at a time onto the medium. The Thorkelson device does not disclose a notched board or elastic threads that create an adjustable grid pattern.

Adhesive alignment grids are disclosed in Hill, U.S. Pat. No. 5,673,490. The Hill device is a transparent sheet of material with a layer of adhesive coating on one side. Alternatively the material may be a flexible transparent a material suitable for creating adhesion through static cling. This adhesive sheet may be affixed to windows, mirrors, or the glass pane of a picture frame. An image lying on the opposing side of the glass can then be transcribed to another medium by drawing gridded sections of the image onto the other medium. The Hill device does not have notched edges, nor does it disclose the elastic threads of the present invention.

Similarly, Caperton, Jr. U.S. Pat. No. 3,660,903, discloses a flexible transparent sheet stretched between two rollers. Objects on one side of the transparent sheet are viewed by an artist standing on the opposing side of the sheet, through the printed grid pattern. The image is then drawn by the artist onto a sheet of drawing paper with corresponding gridlines. The flexible grid sheet does not have notched edges, nor does the device include elastic threading.

Pipes, Jr., U.S. Pat. No. 6,579,099 discloses a device hat assists developing artists with proportionally accurate transcription of images. This device includes a sighting grid through which a subject is viewed, a flexible arm attached to the bottom of the sighting grid, a drawing board attached to an opposing end of the flexible arm, and a grid stencil. Charcoal dust is rubbed on the stencil, which is then pressed onto a user's drawing paper to create a replica of the grid pattern displayed on the sighting grid. Users view a subject through the sighting grid and then draw what they see through each grid block onto their drawing paper. Though this device is likely helpful in teaching new artists how to draw subjects, it does not disclose the notched edges or elastic threading of the present invention and thus is not modifiable in the same manner.

These prior art devices have several known drawbacks. They do not disclose a means for easily modifying the size and alignment of a grid pattern. The present invention addresses this need by providing notched edges and elastic threading that removably affixes to same. It substantially diverges in design elements from the prior art and consequently it is clear that there is a need in the art for an improvement to existing drawing grid devices. In this regard the instant invention substantially fulfills these needs.

SUMMARY OF THE INVENTION

In view of the foregoing disadvantages inherent in the known types of drawing frames now present in the prior art, the present invention provides a new modifiable grid pattern wherein the same can be utilized for providing convenience for the user when customizing proportion of scene elements.

The invention is an artist's frame with notches evenly spaced around its edges. These notches are preferably small rectangular or trapezoidal cutouts. Elastic threads are stretched across an upper surface of the frame and wound around frame segments disposed between notches. Threads are wound around the segments at even intervals to create a grid pattern that extends across the upper surface of the frame. Threads can be repositioned at different intervals by winding them around various edge segments. The frame itself may have any geometric cross-sectional shape. Circular, triangular, rectangular, and even octagonal shapes are all contemplated for shape of the frame.

In embodiments where the drawing frame is made from a transparent material, images may be placed underneath the frame. The underlying image is visible to the artist and will appear with the customized grid configuration overlay. Alternatively, the drawing frame may be made from aluminum or other opaque material. In these embodiments, the image is slid in between the upper surface of the frame and the elastic threads. If the fame has a large central cutout region, rather than being continuously solid all the way across, then the frame may be made of any material that is lightweight and durable.

It is therefore an object of the present invention to provide a new and improved drawing frame device that has all of the advantages of the prior art and none of the disadvantages.

It is another object of the present invention to provide a customizable grid pattern that can be used as a guide for transcribing image elements.

Another object of the present invention is to provide a lightweight, portable drawing frame.

Yet another object of the present invention is to provide a drawing frame in which the grid pattern can be modified into disproportionate sectors if so desired.

Still another object of the present invention is to provide a drawing frame that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
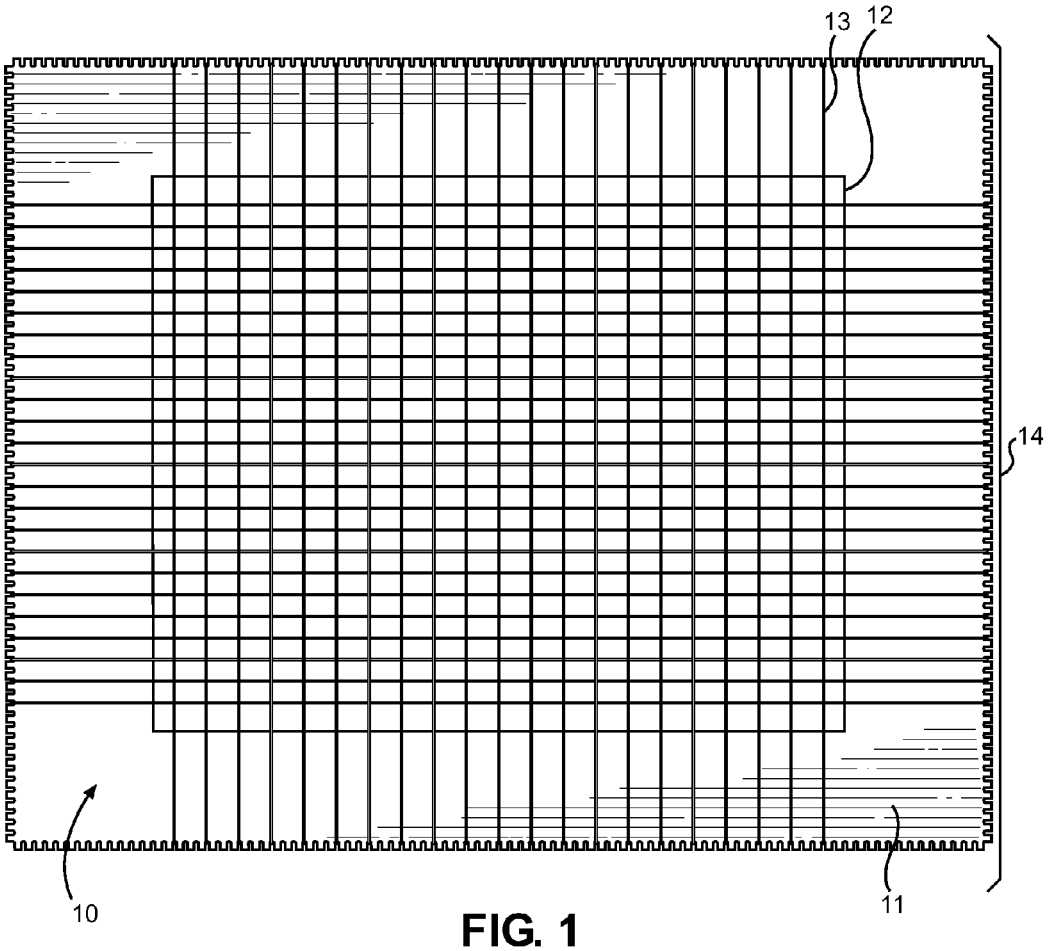
FIG. 1 shows an overhead view of he drawing frame in use.

Reference is made herein to the attached drawings. Like reference numerals are used throughout the drawings to depict like or similar elements of the customizable drawing frame. For the purposes of presenting a brief and clear description of the present invention, the preferred embodiment will be discussed as used for aiding in the transcription of an image to a piece of drawing paper. The figures are intended for representative purposes only and should not be considered to be limiting in any respect.

Referring now to FIG. 1, there is shown an overhead view of the drawing frame device 10. The frame body 11 is depicted as a square shape with four interior perimeter edges 12 defining a cutout region, and four outer perimeter edges 14. Though the interior perimeter edges are continuously smooth, the outer perimeter edges have a series of notches disposed at regular intervals. Portions of the frame body protruding from between notches serve as securing points for elastic threads 13. Groups of these elastic threads are stretched across a portion of the frame body and would around the protruding segments to secure the threads in position. Orienting a first grouping of elastic threads in a lateral alignment and a second grouping of threads in a longitudinal alignment results in formation of a grid pattern. The size of grid pattern sectors can be easily modified through repositioning of elastic threads. By way of example, removal of every other thread from the longitudinal and lateral groupings shown in the illustration, a user can quadruple the area of each grid sector.

Figure 2:
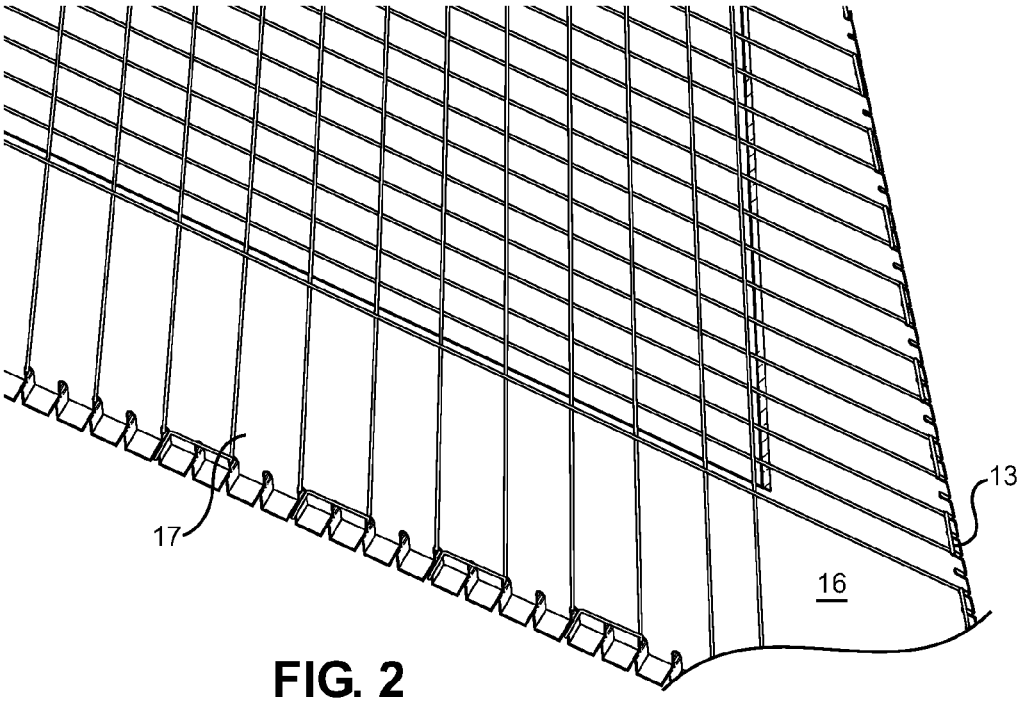
FIG. 2 shows a perspective view of a portion of the frame. The outer edge and upper surface are visible, with elastic threads extending across the interior of the frame.

Turning now to FIG. 2, there is shown a corner portion of the drawing frame device. The front surface 15 of the frame body 11 is shown, with the interior perimeter edges and outer perimeter edges of a corner visible. A plurality of small rectangular notches is disposed at even intervals along the outer perimeter edges. The positioning of these notches results in protruding segments 17 between notches. In use, a number of elastic threads 13 are stretched across the front surface of the frame body and wound around the protruding segments. It is preferred that the elastic threads do not extend across the back surface of the frame body, so as to allow the drawing frame to lay flat when placed on a support structure with the rear surface facing downward.

Figure 3:
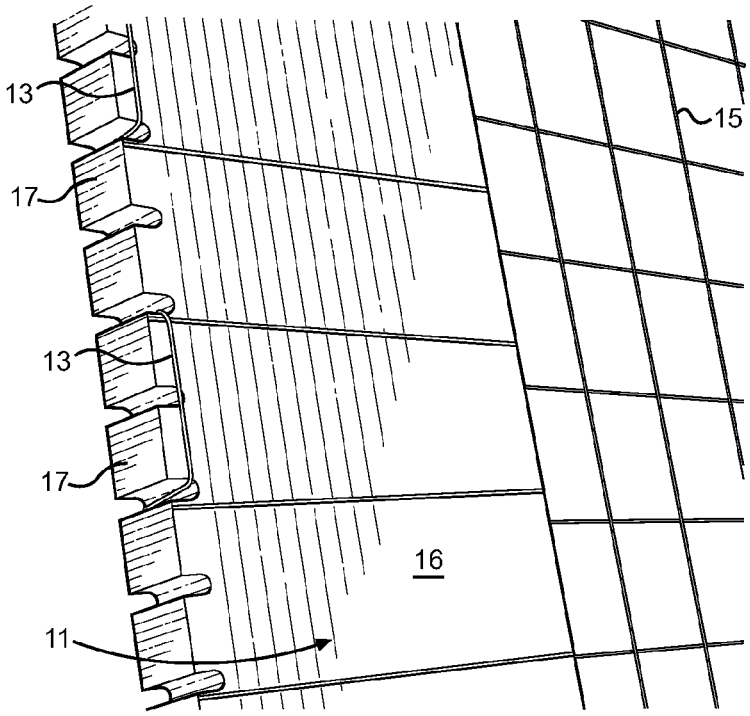
FIG. 3 shows a close-up perspective view of the drawing frame. Elastic threads are wound around edge segments disposed between notches.

The back of the drawing frame device is illustrated in FIG. 3. A plurality of elastic threads 13 extends across the drawing frame front surface (not pictured) and secures to protruding segments 17. These threads do not extend across the rear surface 16 of the frame body 11. In some embodiments, the elastic threads may be closed loops, such that opposing ends of the loops are slipped over the protruding segments, and held in place by tension. Alternatively, the elastic threads may be a single length with a loop at each end. The loops may be slipped over opposing protruding segments and held in place by tension. In still another embodiment, the elastic threads may be a single length without loops. These threads must be wound tightly around the protruding segments to affix the threads to the frame body.

In use, the user selects an image for transcription. If the image is smaller in area than the central cutout region of the drawing frame, then it can be set-aside for the moment. If the image is larger than the central cutout region then it must be placed on the front surface of the drawing frame. In either case, elastic loops are stretched across the front surface of the frame body and secured to the protruding segments at opposing outer perimeter edges. All the elastic threads in a group are attached in parallel alignment. Next another group of elastic threads is secured to the frame in parallel alignment to each other and perpendicularly to the first group of threads. This creates a grid pattern. The frame can then be placed over the selected image. A second frame, set up in this fashion can be placed over a blank sheet of drawing paper, thereby sectioning off the blank paper into grid sectors. Sections of the image are transcribed one at a time onto the drawing paper grid sectors. In this way, a user can easily transcribe images and maintain proportions, without having to draw grid patterns directly onto a piece of paper.

The drawing frame device is an art creation tool that assists artists with the task of transcribing an image onto a piece of paper. The device eliminates the need to draw gridlines directly onto a piece of paper by supplying modifiable grid patterns. Users can adjust positioning of elastic threads in order to change the size and shape of grid sectors.

The drawing frame is made of a lightweight material for easy portability. It may be a transparent plastic composite, aluminum, or any other suitably durable material. The frame body may have a variety of shape configurations. Examples include circular, rectangular, triangular, hexagonal, octagonal, and the like. Similarly, the shape of the notches on the outer perimeter edge may vary. They are depicted herein as being rectangular channels extending into the frame body, but they can also be tear drop shaped, trapezoidal, or any other shape that has walls that are either parallel, or that are wider toward the interior of the body than they are at the outermost edge portion. Notches that hare smaller interior diameter than outer diameter will promote slippage of elastic threads, and are not suitable for use with the present invention.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. The frame body itself may have a hollow cutout region in the center or may be a continuously solid piece of transparent material.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A drawing frame, comprising:

a planar frame;

a cutout region through the planar frame, the cutout region bounded by an inner perimeter edge of the frame;

a plurality of notches disposed along an outer perimeter edge of the frame, the plurality of notches spaced evenly and defining protruding segments therebetween;

a plurality of elastic threads removably wound about the plurality of protruding segments; and the plurality of elastic threads including a first set of threads arranged perpendicularly to a second set of threads, the first set of threads and the second set of threads forming a grid pattern extending across the cutout region.

2. The drawing frame of claim 1, wherein the planar frame is constructed from a transparent material.

3. The drawing frame of claim 1, wherein the plurality of elastic threads extend across a front surface of the planar frame, the plurality of elastic threads are configured to not extend across a rear surface of the planar frame.

* * * * *